United States Patent [19]

Jarman et al.

[11] Patent Number: 4,718,266

[45] Date of Patent: Jan. 12, 1988

[54] PINCH WELD PULL CLAMP

[76] Inventors: Davis R. Jarman, Rte. 1, Box 844B, Hortense, Ga. 31543; Virgil H. Hinson, 206 Fairway Oaks Dr., Brunswick, Ga. 31520

[21] Appl. No.: 876,161

[22] Filed: Jun. 19, 1986

[51] Int. Cl.[4] ..... B21D 1/12

[52] U.S. Cl. ..... 72/422; 72/705; 24/459; 24/569

[58] Field of Search ..... 72/308, 422, 705, 457; 403/381; 24/459, 525, 569, 265 R

[56] References Cited

U.S. PATENT DOCUMENTS

| | | | |
|---|---|---|---|
| 3,338,086 | 8/1967 | Hunter | 72/457 |
| 4,106,325 | 8/1978 | Kuhn | 72/457 |
| 4,457,159 | 7/1984 | Jarman et al. | 72/705 |
| 4,596,105 | 6/1986 | Farmer | 403/381 |

*Primary Examiner*—Lowell A. Larson

*Attorney, Agent, or Firm*—Fleit, Jacobson, Cohn & Price

[57] ABSTRACT

A pair of generally parallel, laterally spaced and registered plates are provided including corresponding opposite margins having projections supported therefrom and spaced therealong projecting toward and engageable with the corresponding margin of the opposing plate. The projections on corresponding margins of the opposing plates are staggered relative to each other and clamp fastener structure is secured through the mid-portions of the plates for forcibly drawing the plates toward each other and clamping sheet metal portions between one pair of corresponding projection equipped margins thereof. At least one marginal edge of one of the plates includes anchor structure supported therefrom, to which a pull member may be removably anchored.

5 Claims, 6 Drawing Figures

FIG. 1
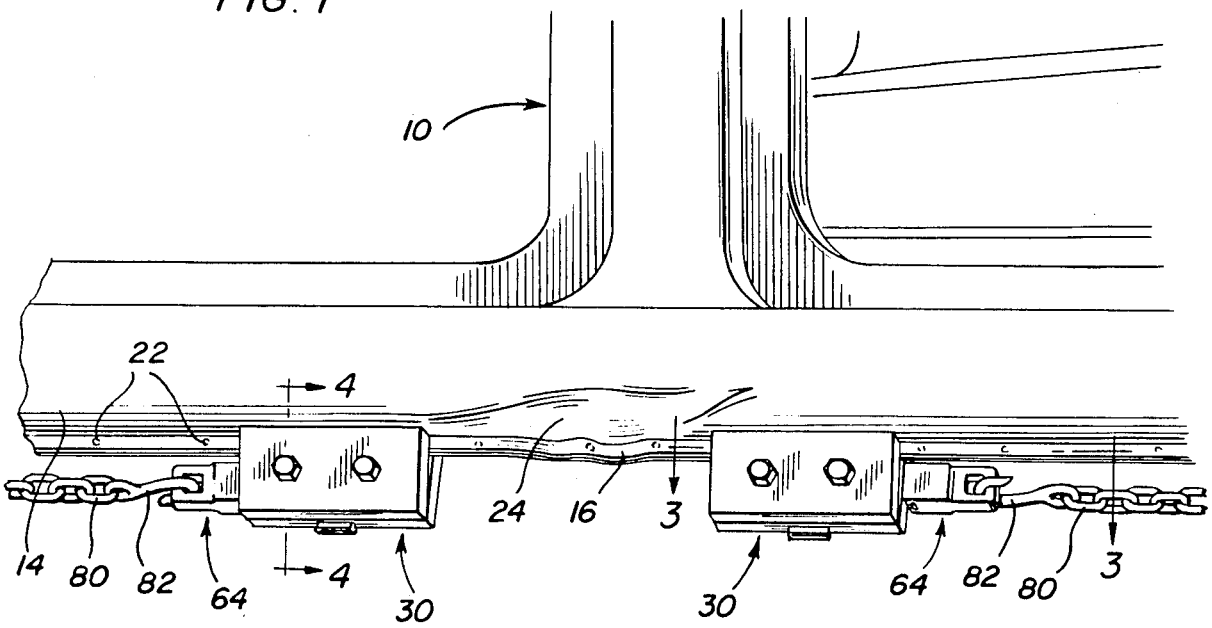
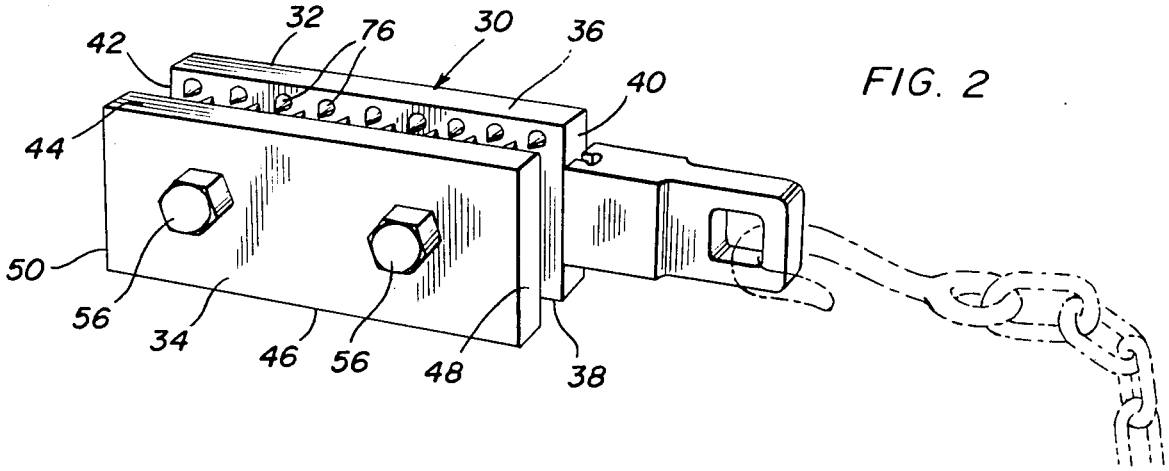
FIG. 2
FIG. 3
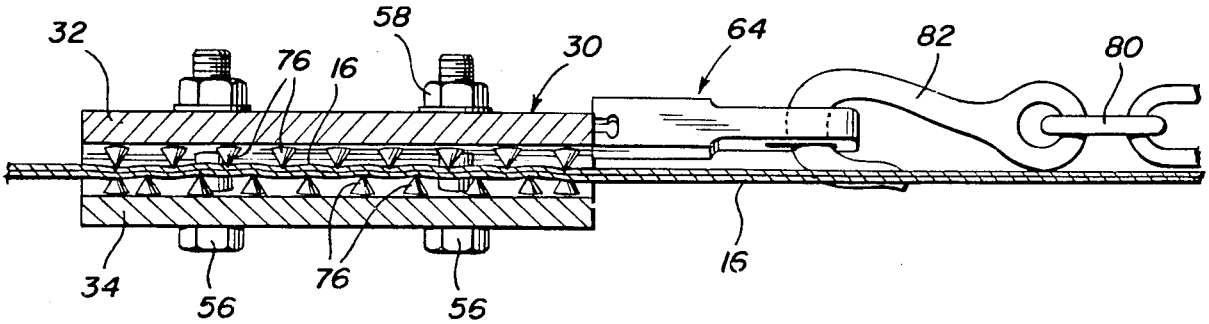

PINCH WELD PULL CLAMP

BACKGROUND OF THE INVENTION

1. Field of the Invention

This invention relates to a clamp incorporating a pair of clamp plates and interconnected through the utilization of a pair of threaded shanktype fasteners and wherein the clamp plates include opposing and interspaced sheet metal engaging projections extending along corresponding registered marginal portions of the plates for clampingly engaging a vehicle body pinch weld area therebetween.

2. Description of Related Art

Various different forms of clamps heretofore have been designed for anchoring relative to sheet metal body portions and enabling a pulling force to be exerted on such sheet metal body portions through the clamps.

Examples of such previously known forms of clamps including some of the general structural and operational features of the instant invention are disclosed in U.S. Pat. Nos. 4,457,159, 4,324,125, 4,315,424, 4,148,210, 4,037,456, 3,992,921, 3,955,249, 3,986,746, 3,827,279, 3,744,838, 3,355,777, 2,989,337 and 1,457,104. However, these previously known clamps do not include the versatility features of the instant invention.

SUMMARY OF THE INVENTION

The clamp of the instant invention comprises a pair of rectangular plates disposed in laterally spaced relation with opposing side surfaces of the plates registered with each other and including remote marginal portions provided with outwardly projecting sheet metal panel engaging members spaced therealong. The sheet metal engaging members of one plate marginal portion are receivable between the sheet metal engaging members of the other plate corresponding marginal edge portion. The central areas of the plates disposed between the aforementioned remote marginal portions include pairs of registered apertures formed therethrough and threaded shank-type fasteners are secured through the pairs of registered apertures for clamping the plates together. The projections along one pair of corresponding marginal portions of the plates may bite into, deform and frictionally grip a sheet metal edge portion or pinch weld area therebetween while the projections spaced along the other pair of corresponding marginal portions of the plates act as fulcrum points, whereby tightening of the threaded shank-type fasteners will cause the marginal portions of the plates between which a sheet metal marginal portion or pinch weld area is disposed to swing toward each other and frictionally grip the sheet metal marginal portion or pinch weld area. At least one of the plates includes multiple marginal edge portion anchor structures whereby a pull member may be removably anchored to the one plate, selectively, along a plurality of marginal edges thereof.

The main object of this invention is to provide a clamp for engaging a sheet metal marginal portion or a sheet metal pinch weld area and including anchor structure by which a pull member may be removably anchored relative to the clamp.

Another object of this invention is to provide a clamp in accordance with the preceding object and including a plurality of anchor structures thereon to which a pull member may be removably anchored, whereby pulls may be applied to the clamp in different directions.

Yet another object of this invention is to provide a pull clamp specifically designed for use in conjunction with a pinch weld area of an automotive body.

Another object of this invention is to provide a clamp for anchoring a pull member to sheet metal portions used in different environments.

A final object of this invention to be specifically enumerated herein is to provide a pull clamp in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of a lower rocker panel area of a 4-door vehicle with a pair of clamps of the instant invention operatively associated with the pinch weld area of the rocker panel area.

FIG. 2 is an enlarged perspective view of the right-hand clamp illustrated in FIG. 1;

FIG. 3 is an enlarged horizontal sectional view taken substantially upon the plane indicated by the section line 3—3 of FIG. 1;

DESCRIPTION OF THE PREFERRED EMBODIMENTS

Figure 4:
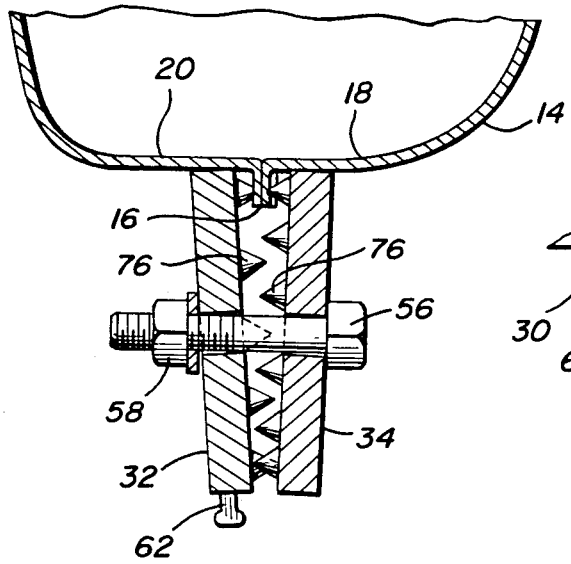
FIG. 4 is an enlarged vertical sectional view taken substantially upon the plane indicated by the section line 4—4 of FIG. 1.

Referring now more specifically to the drawings, the numeral 10 generally designates a vehicle body of conventional construction including the rocker panel area 14 having a pinch weld area 16 in which angulated flanges of a pair of sheet metal sections 18 and 20 are welded together by spot welds 22.

Rocker panel areas such as area 14 sometimes experience minor damage such as that indicated at 24 and such minor damage may be repaired by straighten, rather than replacing an entire rocker panel. However, conventional methods of straightening rocker panels involves the securement of pull member anchors to the panels either by welding or fasteners secured to the panel and each of these methods of attachment of pull anchors results in further damage to the panels which also must be repaired. Accordingly, a need exists for structure whereby a single or multiple pulls may be exerted on a rocker panel pinch weld area without damage to the rocker panel itself. To this end the clamp-type anchor of the instant invention has been designed. The clamp is generally referred to by the reference numeral 30 and may be used singly or in pairs to anchor a single pull member or a pair of pull members to the pinch weld area 16.

The clamp 30 comprises a pair of rectangular plates 32 and 34. The plate 32 includes opposite side longitudinal margins 36 and 38 and opposite end transverse margins 40 and 42 while the plate 34 includes opposite longitudinal margins 44 and 46 and opposite end transverse margins 48 and 50. The plates 32 and 34 are of substantially the same length, width and thickness and are laterally registered with each other and include longitudinally spaced centrally transverse bores 52 and 54 formed transversely therethrough and generally equally spaced between the opposite end and side margins of the plates 32 and 34, the bores 52 and 54 being registered with each other and threaded shank-type bolts 56 being secured through the bores 52 and 54 by threaded nuts 58.

The margin 40 includes an outstanding anchor rib 60 extending longitudinally therealong and the rib 60 is generally keyhole shaped in transverse cross section. In addition, the longitudinal margin 38 also includes an anchor rib 62 of similar configuration.

Figure 6:
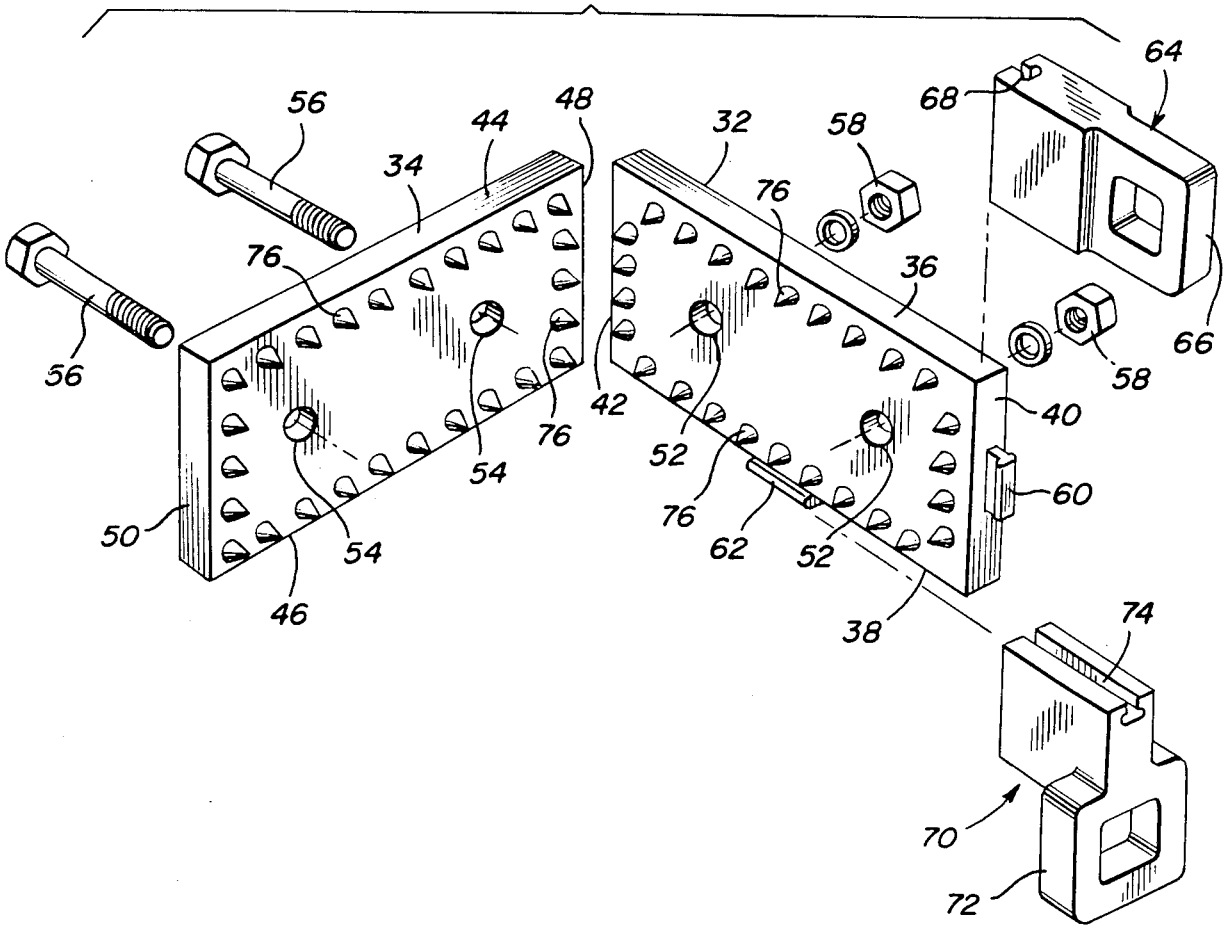
FIG. 6 is an exploded perspective view of the clamp with two different forms of pull member anchors in exploded position relative thereto.

A first form of anchor member is illustrated in FIG. 6 and referred to in general by the reference numeral 64. The anchor member 64 includes an anchor eye 66 on one end and a transverse open ended keyhole-shaped slot 68 on the other end in which either rib 60 or 62 may be slidingly received. A second anchor member is referred to in generally by the reference numeral 70 in FIG. 6 and includes an anchor eye 72 corresponding to the anchor eye 66 and an open ended slot 74 corresponding to the slot or groove 68 in which either of the ribs 60 and 62 may be slidingly received. It may be seen that the anchor eye is rotated 90° with respect to the anchor eye 66.

Each of the margins 36, 38, 40, 42, 44, 46, 48 and 50 includes a row of pointed projections 76 extending therealong and facing toward the opposing plate. The projections 76 of each row of projections on one plate are receivable between projections in the corresponding row of projections 76 on the other plate when the openings 52 and 54 are registered with each other. Further, either of the anchor members 64 or 70 may be removably engaged with either the rib 60 or the rib 62. In addition, the plate 34 also may be provided with ribs 60 and 62.

Figure 5:
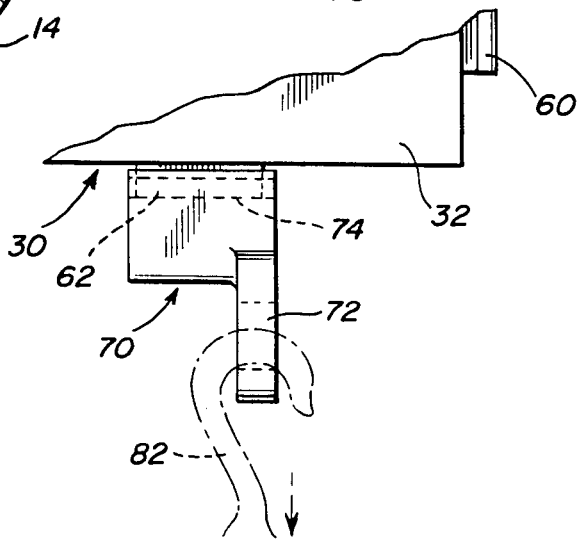
FIG. 5 is a fragmentary enlarged elevational view of the lower right-hand portion of the clamp illustrated in FIG. 2 with a second form of pull member anchor operatively engaged therewith.

In operation, and with attention directed more specifically to FIGS. 1, 2 and 3 of the drawings, the fasteners or bolts 56 of the right clamp 30 may be loosely secured through the corresponding bores 52 and 54 and the pinch weld area 16 to the right of area 24 may be disposed between the projections 76 carried by the margins 34 and 36. The nuts 58 may be gradually tightened on the bolts 56, and, as the bolts 56 clamp the plates 32 and 34 together, the row of projections 76 carried by the margins 38 and 46 contact the opposing plate margins and therefore define a fulcrum axis about which the margins 36 and 44 may swing toward each other, whereby the projections 76 carried by the margins 36 and 44 will tightly frictionally grip and slightly deform the pinch weld area 16 therebetween. Then, with a pull member such as a chain 80 having its hook 82 engaged with the right-hand anchor member 64 illustrated in FIG. 1, a pull on the pinch weld area 16 to the right of the damaged rocker panel area 24 may be exerted. A second clamp 30 may be clampingly engaged with the pinch weld area to the left of the damaged area 24 and a second chain 80 and its hook 82 may be engaged with a second corresponding anchor member 64 supported from the left-hand clamp 30 in order to exert a pull to the left as viewed in FIG. 1. In this manner, the damaged rocker panel area 24 may be stretched to straighten the same. Also, with attention invited now more specifically to FIG. 5, it may be seen that the anchor member 70 may be utilized in conjunction with a chain hook 82 to exert a downward pull on a pinch weld area with which one of the clamps 30 is clampingly engaged.

In addition to the clamp 30 being engageable with a pinch weld area 16, the clamp 30 may also be engaged with any exposed marginal portion of a sheet metal panel. In addition, the projections 76 may have pointed or rounded outer extremities and the projections 76 may have other than basic conical configurations.

Also, when the projections 76 on the end margins of the plates 32 and 34 are to be used to clampingly engage a pinch weld area 16 or any exposed marginal edge of a sheet metal panel, it may be necessary to progressively tighten the bolts 56, inasmuch as the effective length of the fasteners comprising the bolts 56 will be different when the end marginal edges of the plates 32 and 34 are swung toward each other.

It is also pointed out that the lower marginal edge portion of the plate 34 illustrated in FIG. 4 may include an anchor rib corresponding to the anchor rib 62. When a pair of anchor ribs 62 are provided, a pair of anchor members 64 may be used in conjunction therewith and the anchor members are then downwardly convergent toward their corresponding anchor eyes 66 so that a single hook may be engaged therethrough. Still further, the longitudinal margins of the plates 32 and 34 may include longer anchor ribs or a pair of anchor ribs 62 in order that a pair of the anchor members 70 may be engaged therewith.

As may best be seen from FIG. 3 of the drawings, the clamping action of the projections 76 carried by the upper margins 36 and 44 of the plates 32 and 34 distort the pinch weld area 16 therebetween in order that the clamp plates 32 and 34 may attain a secure anchoring grip on the pinch weld area 16. With such a secure grip, a pull may be made longitudinally or transversely of the pinch weld area 16. Of course, after a straightening procedure has been carried out utilizing the clamp 30, the pinch weld area may be readily straightened prior to refinishing through the utilization of a bumping hammer and dolly.

If each of the plates 32 and 34 includes an end anchor rib 60 and a side anchor rib 62, should it be necessary for the clamp plates 32 and 34 to closely underlie the under surfaces of the rocker panel area 14, the plates 32 and 34 will be turned in a manner such that both of the longitudinal anchor ribs 62 are carried by the lower marginal edges of the plates.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sheet metal margin edge pull clamp including a pair of elongated, generally planar, laterally spaced and generally parallel plates, said plates each including a pair of generally parallel opposite side marginal portions and a pair of opposite end transverse marginal portions, said plates being disposed with said pairs of opposite side and end marginal portions registered with each other, said pair of opposite side and end marginal portions of said plates including sheet metal gripping projections spaced along and projecting toward the other plate with the projections spaced along one marginal portion being interposed between the projections on the corresponding marginal portion of the other plate for contact of the outer extremities of the projections of each plate marginal portion with the opposing side of the corresponding marginal portion of the other plate, a pair of threaded shank-type clamp fasteners spaced apart along said plates and generally equally from said opposite end and side marginal portions and operably connected between said plates to adjustably, positively, draw the central portions of said plates together, one end marginal portion and one side marginal portion of at least one of said plates including an outstanding elongated rib carried by an extending along the corresponding marginal portion, said ribs being generally keyhole shaped in transverse cross-section, an anchor member, said anchor member defining a keyhole-shaped slot in one marginal portion therein in which said ribs are selectively removably slidably receivable, said anchor member also including a second marginal portion remote from said one marginal portion of said anchor member defining an anchor eye, said rib carried by said one end marginal portion of said one plate being generally centered relative to a plane containing said fasteners and said rib carried by said one side marginal portion of said one plate being disposed in a plane normal to said one plate and generally centered between second and third planes normal to said one plate and containing said fasteners, the positioning of said ribs relative to said shank-type fasteners enabling a pull on an anchor member engaged with the rib on said one end marginal portion of said one plate to be evenly distributed relative to sheet metal clamped between the remote end marginal portions of said plates and a pull on an anchor member engaged with the rib on said one side marginal portion of said one plate to be evenly distributed relative to the sheet metal clamped between the remote side marginal portions of said one plate.

2. The pull clamp of claim 1 wherein said skank-type clamp fasteners and plates include coacting means operative to restrain said plates against displacement relative to each other in planes generally paralleling the medial planes of said plates.

3. The pull clamp of claim 1 wherein said projections comprise conical projections.

4. The pull clamp of claim 1 wherein said anchor eye is disposed in a plane containing said slot.

5. The pull clamp of claim 1 wherein said anchor eye is disposed in a plane normal to said slot.

* * * * *